US005085764A

United States Patent [19]

Meyers et al.

[11] Patent Number: 5,085,764

[45] Date of Patent: Feb. 4, 1992

[54] PROCESS FOR UPGRADING COAL

[75] Inventors: Robert A. Meyers, Tarzana; Walter D. Hart, Upland; Loren C. McClanathan, Manhattan Beach, all of Calif.

[73] Assignee: TRW Inc., Redondo Beach, Calif.

[21] Appl. No.: 452,794

[22] Filed: Dec. 19, 1989

Related U.S. Application Data

[63] Continuation-in-part of Ser. No. 419,659, Oct. 11, 1989, which is a continuation of Ser. No. 770,324, Aug. 27, 1985, abandoned, which is a continuation-in-part of Ser. No. 486,276, Mar. 10, 1983, Pat. No. 4,545,891.

[51] Int. Cl.[5] ..... C10G 1/00

[52] U.S. Cl. ..... 208/404; 44/621; 44/622; 44/624; 44/627; 44/608; 44/620; 208/405; 423/DIG. 12; 201/17

[58] Field of Search ..... 44/621, 622, 627, 624, 44/608, 620; 208/404, 405; 423/DIG. 12; 201/17

[56] References Cited

U.S. PATENT DOCUMENTS

| | | | |
|---|---|---|---|
| 506,051 | 10/1893 | Langville . | |
| 1,703,192 | 2/1929 | Hampton | 208/11 R |
| 1,938,672 | 12/1933 | Ruthruff | 196/26 |
| 2,034,818 | 3/1936 | Loughrey | 196/24 |
| 2,162,221 | 6/1939 | Kasehagen et al. | 44/1 |
| 2,316,005 | 4/1943 | Lachle | 260/428 |
| 2,609,331 | 9/1952 | Cheney | 202/11 |
| 2,694,035 | 11/1954 | Smith et al. | 196/49 |
| 2,768,935 | 10/1956 | Watkins | 196/52 |
| 2,878,163 | 8/1956 | Hutchings . | |
| 2,902,430 | 9/1959 | Kimberlin, Jr. et al. | 208/90 |
| 2,940,919 | 6/1960 | Hemminger | 208/11 |
| 2,950,245 | 8/1960 | Thomsen | 208/348 |
| 2,957,818 | 10/1960 | Fischer | 208/11 |
| 2,980,600 | 4/1961 | Kelley | 208/11 |
| 3,075,913 | 1/1963 | Scheffel et al. | 208/11 |
| 3,108,059 | 10/1963 | Greenwald | 208/11 |
| 3,166,483 | 1/1965 | Masciantonio | 202/25 |
| 3,296,117 | 1/1967 | Ross et al. | 208/11 |
| 3,393,978 | 7/1968 | Murphy et al. . | |
| 3,407,003 | 10/1968 | Durie | 299/4 |
| 3,501,201 | 3/1970 | Closmann et al. | 299/4 |
| 3,510,168 | 5/1970 | Camp | 299/5 |
| 3,522,168 | 7/1970 | Bichard et al. | 208/11 |
| 3,542,666 | 11/1970 | Simpson | 208/11 |
| 3,556,982 | 1/1971 | Kaminsky et al. | 208/11 |
| 3,572,838 | 3/1971 | Templeton | 299/4 |
| 3,644,194 | 2/1972 | Keely, Deceased et al. | 208/11 |
| 3,708,270 | 1/1973 | Birk et al. | 48/202 |
| 3,739,851 | 6/1973 | Beard | 166/254 |

(List continued on next page.)

FOREIGN PATENT DOCUMENTS

WO82/03404 10/1982 PCT Int'l Appl. .

OTHER PUBLICATIONS

*Coal Desulfurization*, R. A. Meyers, 1977, "Pyritic Sulfur Removal Process Caustic Leaching," pp. 201–209, 230–233.

Coal Desulfurization, R. A. Meyers, 1977, pp. 25–54, 230–234.

"Conversion of Coal To Simple Compounds", Parker et al.

Industrial & Engr. Chem., vol. 47, No. 6, Aug., 1955, pp. 1586–1592.

"The Effect of Molten Caustic on Pyritic Sulfur in Bituminous Coal", Masciantonio, pp. 269–275.

*Primary Examiner*—Helane Myers

*Attorney, Agent, or Firm*—Michael B. Farber; Sol L. Goldstein

[57] ABSTRACT

In a process for reducing the sulfur and ash contents of coal, coal is sequentially contacted with fused alkali metal caustic, wash water, and acid. Contacting the coal with the caustic produces water-soluble compounds. Sufficient wash water is used to reduce the temperature of the caustic treated coal and dissolve the bulk of the water-soluble compounds before the water-soluble compounds convert to water-insoluble compounds that precipitate on the caustic-treated coal. Caustic removed from the coal by the water is recovered as anhydrous caustic for again contacting coal.

37 Claims, 1 Drawing Sheet

Figure 1:
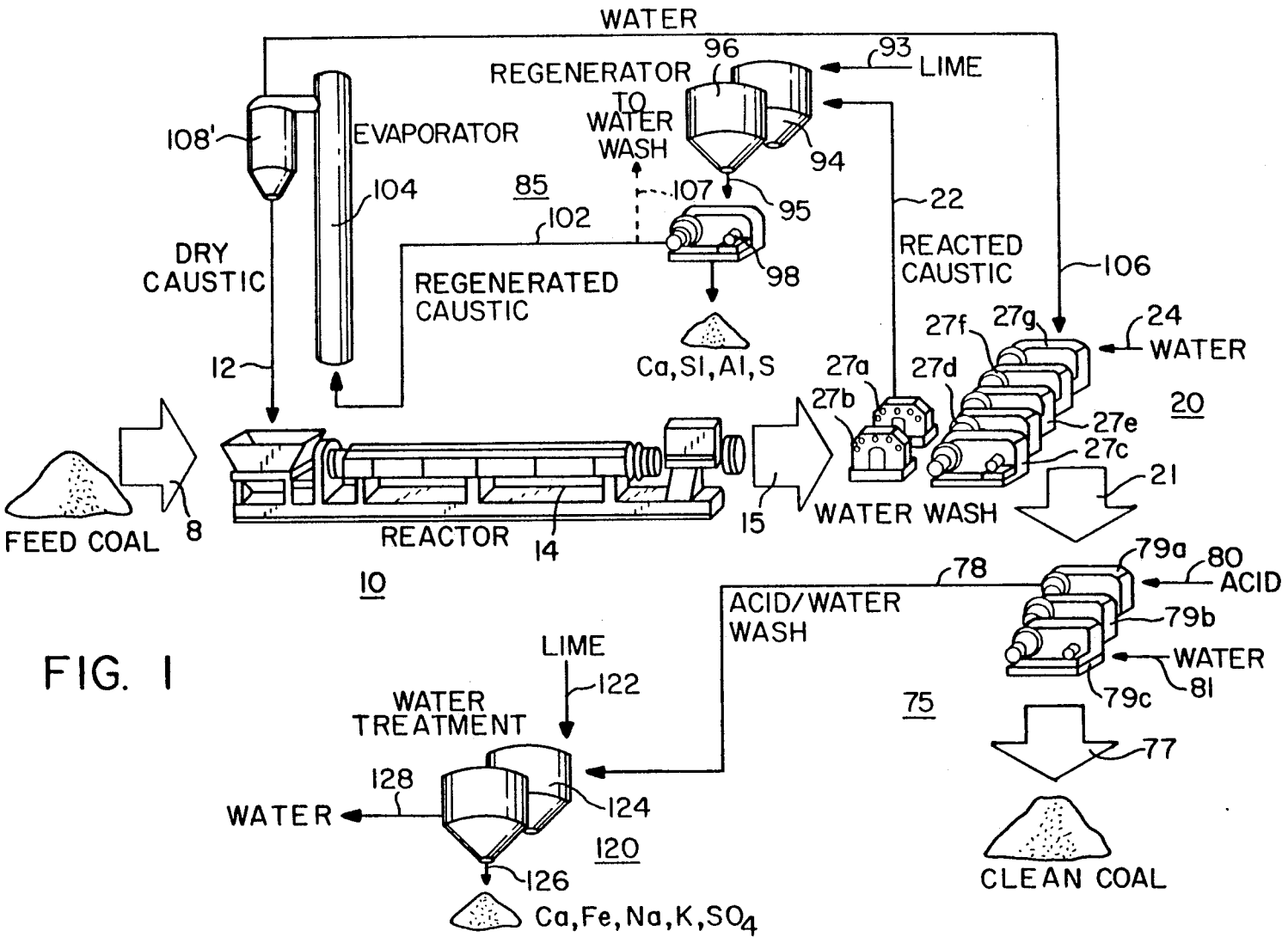

U.S. PATENT DOCUMENTS 3,753,594 8/1973 Beard ..... 299/4
3,759,328 9/1973 Ueber et al. ..... 166/303
3,759,574 9/1973 Beard ..... 299/4
3,779,601 12/1973 Beard ..... 299/4
3,779,722 12/1973 Tatum .
3,788,978 1/1974 Bearden, Jr. et al. ..... 208/208 M
3,846,276 11/1974 Walker ..... 208/11
3,909,213 9/1975 Sanders ..... 44/1 R
3,919,118 11/1975 Robinson et al. ..... 423/461
3,934,935 1/1976 Lambly et al. ..... 299/2
3,951,457 4/1976 Redford ..... 299/5
3,960,513 6/1976 Agarwal et al. ..... 44/1 R
3,966,582 6/1976 Cramer ..... 208/8
3,967,853 7/1976 Closmann et al. ..... 299/4
3,970,434 7/1976 Gasior et al. ..... 44/1 F
3,993,455 11/1976 Reggel et al. .
4,003,823 1/1977 Baird, Jr. et al. ..... 208/108
4,026,359 5/1977 Closmann ..... 166/263
4,032,193 6/1977 Drinkard et al. ..... 299/4
4,055,400 10/1977 Stambaugh et al. ..... 44/1 SR
4,087,514 5/1978 Robinson et al. ..... 423/451
4,092,236 5/1978 Heredy ..... 208/10
4,108,760 8/1978 Williams et al. ..... 208/11
4,118,200 10/1978 Kruesi ..... 44/1 R
4,120,776 10/1978 Miller et al. ..... 208/11
4,130,474 12/1978 Anthony ..... 208/11
4,132,448 1/1979 Davis ..... 299/5
4,134,737 1/1979 Yang ..... 44/1 R
4,152,120 5/1979 Zavitsanos et al. ..... 44/1 R
4,158,638 6/1979 Tsai ..... 208/11
4,167,397 9/1979 Grant ..... 44/1 R
4,168,148 9/1979 Anthony et al. ..... 44/1 SR
4,174,953 11/1979 Sun et al. ..... 44/1 R
4,188,191 2/1980 Longanbach et al. ..... 44/1 F
4,191,425 6/1980 Davis ..... 299/5
4,213,765 7/1980 Wilson ..... 44/15 R
4,226,601 10/1980 Smith ..... 44/10 D
4,260,471 4/1981 Miller ..... 44/1 SR
4,545,891 10/1985 Meyers et al. ..... 208/11 R

PROCESS FOR UPGRADING COAL

RELATED APPLICATIONS

This application is a continuation-in-part of U.S. Patent application Ser. No. 419,659 filed Oct. 11, 1989, which is a file wrapper continuation of Application Ser. No. 770,324 filed on Aug. 27, 1985; which is a continuation-in-part of U.S. Patent application Ser. No. 486,276 filed on Mar. 10, 1983 by Robert Meyers and Walter D. Hart, Now U.S. Pat. No. 4,545,891; which is based on an International Application filed under the Patent Cooperation Treaty, application No. PCT/US82/00394 filed on Mar. 30, 1982, published on Oct. 14, 1982, Publication No. WO82/03404; which is based, as a continuation-in-part, on U.S. application Ser. No. 349,514 filed on Mar. 31, 1981. These applications are incorporated herein by this reference.

BACKGROUND

This invention is directed to a process for reducing the sulfur and ash contents of coal.

The United States, with nearly one-half trillion metric tons of coal reserves, has the largest total coal reserves in the world. Increased coal utilization in this country has been hampered by environmental constraints, such as restrictions on sulfur dioxide, nitrogen oxides, and particulate emissions. There is a need for new technology to meet these environmental constraints at costs acceptable to coal users.

Molten caustic can be used to leach ash and sulfur from coals as described in aforementioned U.S. Pat. No. 4,545,891. Difficulty is incurred in recycling the caustic used in the process. Costly environmental considerations dictate reuse, rather than disposal, of the spent caustic.

Before mentioned Application Ser. No. 770,324 describes a process by Meyers et al. that allows for reuse of the caustic. In this process, the coal is sequentially treated with fused alkali metal caustic, water, carbonic acid, and a strong acid such as sulfuric acid. Although this process allows recovery and reuse of the caustic, it requires two acid-treating steps, which adds to the cost of the process, and necessitates storage of two different acids.

Accordingly, there is a need for a process using molten caustic that can effectively remove sulfur and mineral matter from coal, and enables the caustic and acid solutions to be recovered for reuse in the process, without requiring the use of two different types of acids.

SUMMARY

The present invention provides a process that satisfies this need. Mined coal can be processed to yield a product coal with less than about 0.1% ash and less than about 0.5% sulfur. Also, most of the caustic used in the process is recovered and recycled for reuse. This is important for both economic and environmental reasons.

In general, this is achieved by sequentially treating the coal with fused alkali metal caustic, water, and a strong acid, with attendant steps for recovering the caustic. More specifically, feed coal containing sulfur and mineral matter is treated in a reaction zone with fused alkali-metal caustic at an elevated temperature. The caustic serves to remove mineral matter and sulfur from the feed coal yielding (i) a caustic-treated coal and (ii) water-soluble compounds comprising alkali-metal, mineral matter, and sulfur. The water-soluble compounds are generated by reaction of the alkali-metal with the mineral matter and the sulfur in the feed coal.

Next, the caustic-treated coal and water-soluble compounds are combined in a water wash zone with sufficient wash water to reduce the temperature of the caustic-treated coal and dissolve the bulk, i.e. at least: 50% by weight, of the water-soluble compounds before they convert to water-insoluble compounds that precipitate on the caustic-treated coal. It is important that the temperature in the water wash zone be maintained at no more than about 240° F. and that the residence time in the water wash zone be short, preferably less than about 3 hours, so that the water-soluble compounds remain soluble. If the temperature is too high and/or the residence time is too long, these water-soluble compounds convert to water-insoluble compounds that precipitate onto the caustic-treated coal. Preferably, at least about 80%, and more preferably at least about 90% by weight of the water-soluble compounds are dissolved in the wash water. Optimumly substantially all of the water-soluble compounds are dissolved in the wash water.

The temperature in the water wash zone is maintained at or above about 140°, preferably less than 220° F., more preferably less than about 200° F., and most preferably less than about 180° F. to minimize precipitation of the water-soluble compounds. An effective amount of wash water for dissolving the water-soluble compounds and cooling the coal is an amount from about 1 to about 20, preferably from about 2 to about 10, and more preferably from about 3 to about 6, parts by weight wash water per one part by weight caustic-treated coal. It has been found that the bulk, i.e. at least 50%, of the water-soluble compounds can be dissolved in the wash water if the residence time in the water wash zone is less than about 2 hours, and preferably less than about 1 hour, and most preferably about ½ hour.

With a sufficiently short residence time for the coal and a sufficiently low temperature in the water wash zone, at least about 70%, preferably at least about 80%, and more preferably at least about 90% by weight of the silicon and aluminum in the feed coal are removed by the water wash step. Most preferably substantially all of the silicon and aluminum are removed in the water wash step. Likewise, preferably at least about 70%, more preferably at least about 80%, and most preferably at least about 90% by weight of the sulfur that is removed from the feed coal is removed by the water wash step.

Preferably the water wash zone comprises at least two separate countercurrent stages in series, with the caustic-treated coal and the water-soluble compounds being introduced into the first stage and the wash water being introduced into the last stage. The coal and the wash water pass through the stages countercurrently. Preferably each stage comprises a mixing zone for mixing incoming coal and water and a separation zone for separating the mixture into washed coal and water. Preferably there are least five of these stages.

The washed coal is separated from the spent wash water, the separated coal having a sulfur content lower than the sulfur content of the feed coal and an ash content lower than the ash content of the feed coal. The separated coal is then treated with acid, such as sulfuric acid, to remove additional mineral matter. The product coal contains less than about 0.1% ash and less than about 0.5% sulfur.

Regeneration of the caustic can be accomplished by treating the spent wash water with a calcium containing material to yield an aqueous caustic and a calcium carbonate precipitate. By removing substantially all of the water from the aqueous caustic, a substantially anhydrous alkali metal is produced for recycle to the reaction zone.

By this process, the bulk of the alkali-metal that reacts with the mineral matter and sulfur is washed from the coal with the wash water rather than the acid. This is advantageous because it is much easier to regenerate the caustic from spent wash water than from a spent acid solution. By using the wash water to effectively remove the bulk of the water-soluble compounds from the treated coal, the carbonic acid wash step of the prior Meyers et al. process is not needed.

DRAWING

These and other features, aspects, and advantages of the present invention will become better understood with the reference to the following description, appended claims, and accompanying drawing which schematically shows a preferred process according to the present invention.

DESCRIPTION

A process according to the present invention as shown in the accompanying drawing generally comprises a coal-caustic reaction zone 10, a water wash zone 20, an acid wash zone 75, a caustic recovery zone 85, and a spent acid treatment zone 120.

Coal-Caustic Reaction Zone

Feed coal 8 is fed to a coal-caustic reaction zone 10. Preferably the feed coal 8 is upgraded before entering the coal-caustic reaction zone 10. For example, the coal can be crushed and sized to a dimension of less than about ⅜ inch. Preferably the feed coal 8 is physically cleaned by well known methods such as water washing, flotation separation, etc., to about 10% ash and from about 2 to about 4% sulfur. Although high ash and/or high sulfur content coal can be crushed and used directly in the process, the process is more efficient with cleaned coal. The sulfur in the coal is usually in the form of pyritic and organic sulfur. The ash-forming mineral matter in the coal usually comprises clays, shales, and pyrite, but also comprises lesser amounts of minerals containing substantially every chemical element known.

The feed coal 8 is combined with make-up alkali metal caustic 12 in the coal-caustic reaction zone 10. Caustic materials suitable for this invention include alkali metal caustics. The alkali metal can be selected from Group IA metals of the periodic table, with the hydroxides of sodium and potassium being the preferred alkali metal caustic since they can easily be regenerated. Sodium hydroxide is usually used because of its low cost and availability. Alternatively a mixture of sodium hydroxide and potassium hydroxide can be used. The caustic 12 can be introduced as a dry powder or molten.

The coal-caustic reaction zone 10 is maintained at an elevated temperature at which the caustic material is in a fused or molten state. When the coal contacts molten caustic, sulfur and mineral matter are removed from the coal and become dissolved or suspended in the caustic. The sulfur dissolves in the caustic mainly as alkali-metal sulfides. The ash-forming mineral matter dissolves in the form of aluminates, silicates, ferrites, and the like.

It is believed that among the reactions that occur are the following qualitative reactions:

$$Al_2O_2 + SiO_2 + H_2O + NaOH \rightarrow NaAl(OH)_4 + NaSi(OH)_5 \quad (1)$$

$$FeS_2 + NaOH \rightarrow Fe_x(OH)_y + Na_2S \quad (2)$$

$$Coal-S + NaOH \rightarrow Coal(OH)_2 + Na_2S \quad (3)$$

Equation (1) shows the reaction of the major coal mineral component, alumino silicate, with molten caustic to form sodium salts of aluminum and silicon. Equation (2) shows the reaction of the other major coal mineral component, iron pyrite, with molten caustic to form soluble iron hydroxides and sodium sulfide. Equation (3) shows the reaction of the organic sulfur content of coal with sodium hydroxide to form oxygenated coal and sodium sulfide.

The temperature in the coal-caustic reaction zone 10 is important. Preferably the temperature is from about 280° C. to about 425° C. At temperatures less than about 280° C., the extraction of ash and sulfur is slow and incomplete. At temperatures higher than about 410° C., the coal can lose a substantial amount of its volatiles in coking reactions. The preferred temperature is from about 325° to about 400° C., and more preferably at about 370° C.

Reactor pressure does not appear to have a significant effect on the coal-caustic reaction. Therefore the reaction can be carried out at atmospheric pressure. A small positive pressure can be maintained in the coal-caustic reaction zone 10 to help the reactants flow downstream. A small positive pressure also works to keep air out of the reaction zone 10. The reaction can take place in an inert atmosphere such as under a nitrogen blanket, which can be introduced concurrently or countercurrently with the coal.

The residence time in the coal-caustic reaction zone 10 can be as short as 5 minutes and still give some sulfur and mineral matter extraction. Typically the reactor residence time is from about 1 hour to about 4 hours. However, when a microwave heat source is used, the residence time can be reduced to within the range of from about 1 to about 5 minutes.

Preferably the mass ratio of caustic to coal is from about 1 to about 20 parts by weight caustic per one part by weight of coal. In some applications, the amount of alkali metal caustic fed to the coal-caustic reaction zone 10 needs to be sufficient to form a free flowing slurry with the coal. For those applications, a caustic/coal mass ratio of at least about 4:1 is used because at lower ratios, the coal-caustic mixture is not fluid. At ratios less than about 4:1, the mixture in the reaction zone 10 is "putty-like". Preferably the caustic to coal mass ratio is less than about 20:1 for an economical process and to have a small reactor size. The smaller the ratio, the smaller the reactor size. A typical caustic/coal ratio used in reactor 10 is no more than about 10:1.

Reactors of various designs can be used in the coal-caustic reaction zone 10. There can be a single reactor, or multiple reactors set up in stages. The flow of caustic and coal can be cocurrent or countercurrent. Because coal is less dense than the molten caustic, the coal tends to float to the top of the reaction mixture. It is thus necessary to have good mixing in reaction zone 10 to ensure efficient and sufficient contact between the coal and the fused caustic.

A suitable reactor for use in the coal-caustic reaction zone 10 is a rotary kiln reactor 14 as shown in the drawing. For this type of reactor, low ratios of caustic to coal can be used, on the order of about 1 to about 3 parts by weight caustic per one part by weight feed coal.

An effluent mixture 15 comprising spent fused caustic and caustic treated coal exits the coal-caustic reaction zone 10. The spent fused caustic contains impurities such as sulfides, carbonates, and mineral matter in solution or in a suspended form. These impurities include water-soluble compounds comprising alkali metal, mineral matter, and sulfur. The caustic treated coal has reduced sulfur and mineral matter contents compared to the feed coal 8.

When the caustic to coal mass ratio in the effluent mixture is greater than about 4:1, a portion of the spent caustic can be separated from the mixture 15 for recycle to the reactor 10. Separation can be effected by well known methods for solids/liquid separation, including pressure filters, vacuum filter, or a quiet zone with a separator. In the quiet zone, the effluent mixture 15 is left relatively undisturbed and the coal floats to the surface of the molten spent caustic due to the difference in densities between the coal and the caustic (the specific gravity of coal is about 1.2–1.3 and the specific gravity of caustic is about 1.8 at reaction temperatures). In the separator the coal on top is skimmed or decanted off.

It is desirable to maintain the sulfur concentration in any recycled spent fused caustic at from about 1 to about 2%, and mineral matter concentration at from about 3 to about 5%. Higher sulfur and/or mineral matter concentrations in the recycled spent fused caustic adversely affect the extraction efficiencies in the coal-caustic reaction zone 10.

A small ratio of spent fused caustic to coal is preferred in effluent stream 15. As will be explained later, a substantial portion of the caustic material in this stream is stripped of impurities and regenerated to produce clean caustic for reuse in the reaction zone 10. By limiting the amount of spent fused caustic in the effluent stream 15, it is possible to reduce the equilibrium concentration of ash and sulfur in the caustic in the reaction zone 10.

Water Wash Zone

The mixture of caustic treated-coal and spent fused caustic in the effluent stream 15 is then contacted with water in a water wash zone 20. This separates the spent fused caustic from the caustic-treated coal, producing water-washed coal 21 and a caustic-rich spent wash water 22.

Proper operation of the water wash zone 20 is important to the effectiveness of the process according to this present invention. This is because the water-soluble compounds formed in the reaction zone 10 can revert to insoluble compounds, particularly at high temperatures. When these compounds insolubilize, they precipitate on the coal and are discharged from the water wash zone 20 with the water-washed coal 21 rather than the spent wash water 22. These precipitated compounds are either not extracted from the coal, or need to be extracted from the coal in the acid wash zone 75. To regenerate the acid for reuse in the process, it would then be necessary to remove the precipitated compounds from the spent acid. It is more expensive, more energy-consuming, and more difficult to remove the precipitated compounds from spent acid than it is from the spent wash water 22. Accordingly, it is important to operate the water wash zone to avoid such precipitation.

In particular, the sodium salts of aluminum and silicon formed in reaction (1), although initially soluble in water or aqueous caustic, quickly revert to insoluble alumino silicate at elevated temperatures, if allowed to stand for excess amounts of time, or if provided a nucleating surface such as lime or calcium carbonate. Similarly, the sodium sulfide produced in reactions (2) and (3) precipitates upon standing, heating of the liquid, or addition of a nucleating surface.

Accordingly, the water wash zone is operated to maintain short residence time and low temperatures. Preferably, the residence time of the coal in the water wash zone 20 is less than about 3 hours, more preferably less than about 2 hours, and most preferably less than about 1 hour, and optimumly only about ½ hour. The temperature throughout the water wash zone is less than about 240° F., preferably less than about 220° F., more preferably less than about 200° F., and most preferably less than about 180° F.

As be discussed below, the water added in the water wash zone 20 is removed in order tc generate clean dry caustic for reuse in coal-caustic reaction zone 10. Water removal consumes energy. Therefore it is preferable that a minimum amount of wash water be used, subject to the requirement that the temperature in the water wash zone 20 be sufficiently low to minimize precipitation of the water-soluble compounds formed in the reaction zone 10. The amount of water used is preferably from about 1 to about 20 parts by weight water per part by weight feed coal, more preferably from about 2 to about 10, and most preferably from about 3 to about 6 parts by weight water per part by weight coal.

As shown in the drawing, preferably a countercurrent staged water wash system is used. In each stage, coal is slurried with water, and the slurry is separated into wet coal and a liquid, the coal being sent to the following stage and the liquid to the prior stage. The final wash stage can use essentially pure water, such as a condensate 106 from a water removal zone 104 (described below) and make-up water 24. Optionally, dilute aqueous caustic generated in other parts of the process, such as a side stream 107 taken off from stream 102 from a caustic regenerator 94, can be added to the wash water in any wash stage but the final stage. Stream 107 contains 5 to 10% aqueous caustic and is destined for the water removal zone 85, as will be explained later. Bypassing the water removal step saves energy.

A preferred water wash zone 20 as shown in the drawings include seven sequential stages 27A, 27B, 27C, 27D, 27E, 27F, and 27G. The make-up water 24 and recycle water 106 added to the system are added to the last stage 27G and the caustic-treated coal 15 is added to the first stage 27A.

Each stage comprises a mixing zone for mixing incoming coal and water and a separation zone for separating the mixture into wash coal and water. The mixing zones are not shown in the drawing, but generally comprise a stirred tank. Preferably the separation zones for the first two stages 27A and 27B are rotary drum vacuum filters. The separation zones for the last five stages 27C–27G are centrifuges.

The temperature of the coal tends to be the highest in the first stage 27A because of the high temperature of the coal and the caustic effluent 15 exiting the reaction zone 10, and the exothermic heat of solution resulting from dissolving the caustic in water. To maintain the temperature in the first stage below about 240° F., and most preferably below about 180° F., preferably cooling is used in the first stage. This cooling can be provided by an evaporative condenser used on the first stage mixing vessel. Alternatively, the first stage mixing vessel can be provided with a pump-around loop which extracts a water-coal-caustic slurry from the vessel, pumps the slurry through a water coded heat exchanger, and then the slurry, can be reintroduced into the vessel.

It has been found that the combination of (1) short residence time in all the vessels, less than about ½ hour, (2) temperatures maintained below 180° F., and (3) stirring to keep the coal solids in a homogenous dispersion prevents water-soluble mineral matter from redepositing on the coal, and thus allows the mineral matter to be removed from the coal with the wash water. Substantially all of the alumina and silica originally present in the coal can be extracted in the water wash step, with substantially no deposition of these minerals on the coal. By proper operation of the water wash zone, at least about 70%, preferably at least about 80%, and more preferably at least about 90% by weight of the silicon and aluminum in the feed coal are removed in the water wash step. Most preferably substantially all of the silicon and aluminum are removed in the water wash step.

Likewise, preferably at least about 70%, more preferably at least about 80%, and most preferably at least about 90% of the sulfur that is removed from the feed coal is removed by the water wash step. In other words, for every ten pounds of sulfur removed from the feed coal, preferably at least about seven pounds are removed by the wash water and no more than about three pounds are removed by the acid wash.

As the coal moves down the stages of the countercurrent wash system, it contains less and less ash. The ash content of a feed coal 8 can be decreased by about 40% from 11% ash to only about 7.5% ash through the water-wash step. Moreover, what is measured as "ash" is predominantly sodium or sodium and potassium oxides and iron oxide. The water-washed coal 21 contains only small quantities (only parts per million) of silica and alumina.

Pressure does not appear to affect the water wash performance. To obviate the need for costly pressurized equipment, preferably the water wash is conducted at atmospheric pressure.

Foaming can be a problem in the water wash system 20. Preferably a defoamer that is effective in alkaline solutions is used, such as the defoamers typically used for latex paints and coating systems. A preferred defoamer is Foamkill® 608 from Crucible Chemical Company of Greenville, S.C.

The spent wash water 22 can contain about 40% to about 60% by weight alkali metal caustic, including alkali metal sulfides that were present in the spent fused caustic/coal mixture 15. Alkali metal sulfides have a solubility of 1% or more in fifty percent aqueous caustic at elevated temperatures. The effluent spent wash water 22 also contains some water-insoluble mineral matter.

The water-washed coal 21 preferably has a free caustic content of no more than about 5% by weight. More preferably, the free caustic content is less than about 1% by weight of the coal. The water-washed coal 21 also contains chemically bound alkali present in the caustic-treated coal. Water washing does not remove the chemically bound alkali metal species unless an economically infeasible number of water washes are used.

Acid Wash Zone

The water-washed coal 21 is passed to the acid wash zone 75 where the coal 21 is contacted with a strong mineral acid such as sulfuric acid to form acid-washed coal 77, the product of this process, and spent acid 78.

The acid wash can be effected at room temperature and pressure. The residence time of the coal in the acid wash zone 75 is at least 10 minutes and can be as much as 20 minutes to insure that the bulk of the bound alkali on the coal is removed.

The acid wash can be effected in one stage or in multiple stages, either cocurrently or countercurrently. As shown in the drawings, preferably three stages 79A, 79B, and 79C are used. Each stage comprises a mixing vessel (not shown) and a separator, which preferably is a centrifuge separator. Concentrated acid 80 and the water washed coal 21 are fed to the first stage 79A and dilution water 81 is fed to the third stage 79C. The acid-washed coal 77 is removed from the third stage 79C and the spent acid is removed from the first stage 79A. The acid extraction and treatment of the coal principally occurs in the first stage 79A, and the second 79B and third 79C stages are used primarily for water washing the acid off of the acid-treated coal. The acid-washed coal 77, which is the product from the process, contains substantially no free caustic.

The acid used can be an organic acid, or sulfuric, sulfurous, nitric, or hydrochloric acid. Preferably, concentrated sulfuric acid 80, about 97%, is introduced into the first stage 79A of the acid wash zone 75, with the dilution water 81 added to the third stage 29C raising the pH in the first stage 79A about 1 to 2. The efficiency of acid removal of bound alkali from the coal 21 is pH dependent. The removal is more complete at lower pH's. Preferably the mixture in the acid wash zone 75 is maintained at a pH of no more than about 2, and preferably at about 1.

The sulfuric acid used can be generated from sulfur recovered from the wash water 22, using sulfur removed from the feed coal. This process generated sulfuric acid is preferred because of its low cost.

The quantity of acid 81 and water 81 used is an amount sufficient to form a free flowing slurry. Preferably from about 5 to about 10 parts by weight diluted acid is used in the first stage 79A per part by weight coal.

The product coal 77 typically has an ash content (mineral matter plus bound alkali) of less than about 0.1% by weight, and preferably contains less than about 0.5% by weight sulfur.

Caustic Recovery Zone

The caustic-rich spent wash water 22, containing from about 40 to about 60% by weight alkali metal caustic and insoluble mineral matter, enters a caustic regeneration zone 85 for regenerating the caustic for use in the coal-caustic reaction zone 10.

A caustic insoluble solid 93 is added to the spent wash water 22 in a regeneration vessel 94 in the caustic regeneration zone 85 to initiate precipitation of mineral matter and sulfides from the supersaturated spent wash water 22. Preferably the caustic insoluble solid is a calcium containing material such as slaked lime; limestone; or quick lime produced by thermal decomposition of limestone. The amount of calcium salt 93 added is preferably in the range of ¼ weight to one weight of salt per weight of dissolved mineral matter and sulfide. The precipitation reaction works best with these concentrations. Calcium carbonate, and silicon, aluminum, and sulfur compounds are precipitated, and the precipitate 95 is removed by well known solid/liquid separation methods such as filtering in a centrifuge filter 98. A storage vessel 96 can be provided between the regeneration vessel 94 and the centrifuge 98.

Regenerated dilute aqueous caustic 102 is discharged from the centrifuge 98 and is fed to a water removal zone such as an evaporator 104. A portion 107 can be used as wash water in the water wash zone 20. A clean substantially anhydrous alkali metal caustic exits the water removal zone 104, is stored in a vessel 108, and is returned to the reaction zone 10 for reuse. It can be provided as a solid or liquid.

Spent Acid Treatment Zone

When the acid used in the acid wash zone 75 is sulfuric acid, the following steps can be taken to treat the spent acid 78 in the spent acid treatment zone 120. The spent acid 78 contains a small amount of alkali metal sulfates and dilute sulfuric acid. It can be neutralized with lime 122 in a spent acid neutralization zone 124 to form a precipitate 126 comprising calcium sulfate, and iron, sodium, potassium compounds. The precipitate 124 can be separated and discharged for disposal by methods such as landfill. The waste water 128 contains a small amount of alkali-metal sulfates, and can safely be discharged. Alternatively, the spent sulfuric acid can be electrolyzed to produce dilute caustic and regenerated sulfuric acid.

Advantages of the Process

The present invention has important advantages over prior art methods using fused caustic to treat coal for removal of sulfur and mineral matter. The invention allows for recycle of most of the caustic used. Recycling of caustic is important for both economic and environmental reasons. Make-up caustic can be expensive. Disposal of waste caustic material can also be costly and difficult from an environmental protection standpoint. The process of this invention allows recycle to be effected economically.

As discussed above, it was discovered that water-soluble mineral matter, including water-soluble compounds containing caustic, can be effectively removed from the caustic treated coal with wash water. This result is achieved by obtaining short residence times and relatively low temperatures in the water wash zone. Without this feature of this invention, the bulk of the alkali would have to be removed from the caustic-treated coal with an acid such as carbonic acid. Not only is this expensive, requiring a carbonic acid wash step in addition to a sulfuric acid step, but regeneration of a clean caustic from sulfuric acid wash effluent is much more difficult and expensive than regeneration of caustic from a water wash effluent.

Effective recycling of caustic achieved with this invention reduces pollution problems. For example, if the sulfuric acid wash removed the bulk of the caustic from the caustic-treated coal 15 rather than the water wash, the solid calcium sulfate in stream 126 for disposal would contain soluble alkali metal compounds, which could leach from the solids sulfate after disposal. But if most of the alkali is removed from the caustic-treated coal in the water wash zone 20, the spent acid stream 78 contains very little soluble alkali species. In turn, the calcium sulfate stream 126 also contains less alkali metal compounds, and the leaching problem is abated. Therefore it is important to remove as much of the alkali as possible at the water wash step.

The process of this invention produces either a crushed coal product or a coal water mixture suitable for pumping. The process is especially attractive because the product coal can be used both to replace oil in boilers, turbines and diesel engines, and as an alternative to flue gas desulfurization for coal fired utilities and industrial boilers. The process serves as a strategic response to potential interruptions in imported oil supplies, and provides for the inevitable shortfall in oil production as world oil reserves begin to run out toward the beginning of the 21st century.

Moreover, all of the steps of the process can be conducted at substantially atmospheric pressure. No expensive pressurized equipment is needed.

Although the present invention has been described in considerable detail with reference to certain preferred version thereof, other versions are possible. Therefore, the spirit and scope of the appended claims should not be limited to the description of the preferred versions contained herein.

What is claimed is:

1. A process for reducing the sulfur content and ash content of a feed coal containing sulfur and mineral matter, the process comprising the steps of:

(a) treating the feed coal in a reaction zone with fused alkali metal caustic at an elevated temperature to remove mineral matter and sulfur from the feed coal yielding (i) a caustic-treated coal and (ii) water-soluble compounds comprising alkali metal, mineral matter, and sulfur;

(b) combining the caustic-treated coal and water-soluble compounds in a water wash zone with sufficient wash water to reduce the temperature of the caustic-treated coal and dissolve the bulk of the water-soluble compounds before the water-soluble compounds convert to water-insoluble compounds that precipitate on the caustic treated coal, the residence time of the caustic-treated coal in the water wash zone being less than about 90 minutes;

(c) maintaining the temperature in the water wash zone at less than about 200° F.; and (d) separating the caustic-treated coal from spent wash water containing dissolved water-soluble compounds, the separated coal having a sulfur content lower than the sulfur content of the feed coal and an ash content lower than the ash content of the feed coal.

2. The process of claim 1 wherein the temperature in the water wash zone is maintained from about 140 to less than about 200° F.

3. The process of claim 1 in which the temperature in the water wash zone is maintained at less than about 180° F.

4. The process of claim 1 wherein the step of combining comprises combining from about 1 to about 20 parts by weight of wash water per part by weight of caustic-treated coal.

5. The process of claim 4 wherein the step of combining comprises combining from about 2 to about 10 parts by weight of wash water per part by weight of caustic-treated coal.

6. The process of claim 5 wherein the step of combining comprises combining from about 3 to about 6 parts by weight of wash water per part by weight of caustic-treated coal.

7. The process of claim 1 comprising the additional step of treating the separated coal with acid to remove additional mineral matter from the separated coal.

8. The process of claim 1 in which the water wash zone comprises at least two separate countercurrent stages in series, wherein the caustic-treated coal and the water-soluble compounds are introduced into the first stage and the wash water is introduced into the last stage, and the coal and wash water pass through the stages countercurrently.

9. The process of claim 8 wherein each stage comprises a mixing zone for mixing incoming coal and water and a separation zone for separating the mixture into washed coal and water.

10. The process of claim 8 comprising at least 5 stages.

11. The process of claim 1 comprising the additional steps of recovering caustic from the spent wash water, and recycling the recovered caustic to the reaction zone.

12. The process of claim 11 in which the spent wash water contains carbonates and in which the step of recovering caustic comprises recovering substantially anhydrous alkaline metal caustic by the steps of:

(i) treating the spent wash water with a calcium-containing material to give an aqueous caustic and a calcium carbonate precipitate;

(ii) separating the aqueous caustic from the precipitate; and (iii) removing substantially all the water from the aqueous caustic to yield substantially anhydrous alkaline metal caustic.

13. The process of claim 12 in which the step of combining the caustic-treated coal with wash water comprises washing with water removed from the aqueous caustic.

14. The process of claim 1 wherein 70% of the water-soluble compounds are dissolved in the wash water.

15. The process of claim 1 in which the mineral matter in the feed coal comprises compounds of aluminum, silicon, and sulfur, and the residence time of the caustic-treated coal in the water wash zone is sufficiently short that at least 70% by weight of the aluminum in the feed coal and at least about 70% by weight of the silicon in the feed coal are present in the spent wash water separated from the caustic-treated coal.

16. The process of claim 15 wherein the temperature in the water wash zone is maintained sufficiently low and the residence time of the caustic-treated coal in the water wash zone is sufficiently short that substantially all of the aluminum and silicon in the feed coal are in the spent wash water separated from the caustic-treated coal.

17. The process of claim 15 wherein at least about 70% by weight of the sulfur is removed from the feed coal by the process is present in the spent wash water separated from the caustic-treated coal.

18. A process for reducing the sulfur content and ash content of a feed coal containing sulfur and mineral matter, the mineral matter comprising compounds of aluminum, silicon, and sulfur, the process comprising the steps of:

(a) combining the feed coal in a reaction zone with fused alkali metal caustic for extracting mineral matter and sulfur from the feed coal, thereby yielding a caustic-treated coal and extracted mineral matter;

(b) combining the caustic-treated coal in a water wash zone with wash water for washing extracted mineral matter from the caustic-treated coal, thereby yielding spent wash water containing extracted mineral matter, the residence time of the caustic-treated coal in the water wash zone being less than about 90 minutes;

(c) maintaining the temperature of the water wash zone at a sufficiently low temperature, less than about 200° F., and separating the caustic-treated coal from the spent wash water in a sufficiently short time that at least about 70% by weight of the aluminum in the feed coal and at least about 70% by weight of the silicon in the feed coal are in the spent wash water, and wherein the separated coal has a sulfur content lower than the sulfur of the feed coal and an ash content lower than the ash content of the feed coal.

19. The process of claim 22 wherein at least about 80% by weight of the aluminum in the feed coal and at least about 80% by weight of the silicon in the feed coal are in the removed spent wash water.

20. The process of claim 19 wherein at least about 90% by weight of the aluminum in the feed coal and at least about 90% by weight of the silicon in the feed coal are in the removed spent wash water.

21. The process of claim 20 wherein substantially all of the aluminum and silicon in the feed coal are in the removed spent wash water.

22. The process of claim 18 in which the temperature in the water wash zone is maintained at less than about 180° F.

23. The process of claim 18 in which the water wash zone comprises at least two separate countercurrent stages in series, wherein the caustic-treated coal and the extracted mineral matter are introduced into the first stage and the wash water is introduced into the last stage, and the coal and wash water pass through the stages countercurrently.

24. The process of claim 23 wherein each stage comprises a mixing zone for mixing incoming coal and water and a separation zone for separating the mixture into washed coal and water.

25. The process of claim 18 wherein the residence time of the caustic-treated coal in the water wash zone is less than about 1 hour.

26. The process of claim 18 wherein the amount of wash water combined in the water wash zone is from about 1 to about 20 parts by weight per part by weight of feed coal.

27. The process of claim 26 wherein the amount of wash water combined in the water wash zone is from about 2 to about 10 parts by weight per part by weight of feed coal.

28. The process of claim 27 wherein the amount of wash water combined in the water wash zone is from about 3 to about 6 parts by weight per part by weight of feed coal.

29. The process of claim 18 wherein at least about 70% by weight of the sulfur removed from the feed coal by the process is present in the spent wash water.

30. The process of claim 29 wherein at least about 80% by weight of the sulfur removed from the feed coal by the process is present in the spent wash water.

31. The process of claim 30 wherein at least about 90% by weight of the sulfur removed from the feed coal by the process is present in the spent wash water.

32. A process for reducing the sulfur content and ash content of a feed coal containing sulfur and mineral matter, the mineral matter comprising compounds of aluminum, silicon, and sulfur, the process comprising the steps of:

(a) combining the feed coal in a reaction zone with fused alkali metal caustic for extracting mineral matter and sulfur from the feed coal, thereby yielding a caustic-treated coal and extracted mineral matter;

(b) combining the caustic-treated coal and extracted mineral matter in wa water wash zone with wash water for washing extracted mineral matter from the caustic-treated coal, the amount of wash water being from about 1 to about 20 parts by weight per part by weight of feed coal, thereby yielding spent wash water containing extracted mineral matter including compounds comprising alkali metal, the residence time of the caustic-treated coal in the water wash zone being less than about 90 minutes;

(c) maintaining the temperature of the water wash zone at a sufficiently low temperature, less than about 200° F., and separating the caustic-treated coal from the spent wash water in a sufficiently short time of less than about 90 minutes so that substantially all the aluminum in the feed coal and substantially all the silicon in the feed coal are in the spent wash water, and at least about 70% by weight of the sulfur removed from the feed coal by the process is present in the spent wash water;

(d) treating the separated coal with an acid for removing iron compounds from the separated coal, thereby producing an acid-washed coal having a sulfur content lower than the sulfur content of the feed coal and an ash content lower than the ash content of the feed coal;

(e) recovering substantially anhydrous alkali metal caustic from the spent wash water by:

(i) treating the spent wash water with a calcium containing material that is insoluble in the spent wash water to give an aqueous caustic and a calcium carbonate precipitate;

(ii) separating the aqueous caustic from the precipitate; and (iii) removing substantially all of the water from the aqueous caustic to yield substantially anhydrous alkali metal caustic; and (f) recycling the recovered caustic to the reaction zone.

33. The process of claim 1 wherein the residence time of the caustic-treated coal in the water wash zone is less than about 1 hour.

34. The process of claim 33 wherein the residence time of the caustic-treated coal in the water wash zone is about ½ hour.

35. The process of claim 33 wherein the residence time of the caustic-treated coal in the water wash zone is less than about ½ hour.

36. The process of claim 25 wherein the residence time of the caustic-treated coal in the water wash zone is about ½ hour.

37. The process of claim 25 wherein the residence time of the caustic-treated coal in the water wash zone is less than about ½ hour.

* * * * *